US006886202B2

(12) United States Patent
Fréchette

(10) Patent No.: US 6,886,202 B2
(45) Date of Patent: May 3, 2005

(54) INFLATABLE SEAT CUSHION

(76) Inventor: Yolain Fréchette, 484 Notre-Dame O., Victoriaville, QC (CA), G6P 1S9

( * ) Notice: Subject to any disclaimer, the term of this patent is extended or adjusted under 35 U.S.C. 154(b) by 0 days.

(21) Appl. No.: 10/378,621

(22) Filed: Mar. 3, 2003

(65) Prior Publication Data

US 2004/0003470 A1 Jan. 8, 2004

Related U.S. Application Data

(60) Provisional application No. 60/360,666, filed on Mar. 4, 2002.

(51) Int. Cl.[7] ..... A47C 20/02

(52) U.S. Cl. ..... 5/654; 5/652; 5/653; 5/655.3

(58) Field of Search ..... 5/644, 656, 652–654, 5/655.3

(56) References Cited

U.S. PATENT DOCUMENTS

| | | | |
|---|---|---|---|
| 4,781,413 | A | 11/1988 | Shumack |
| 5,033,133 | A | 7/1991 | Nissen |
| 5,548,948 | A | 8/1996 | Smith |
| 5,946,723 | A | 9/1999 | DiPrato |
| 5,979,975 | A | 11/1999 | Hiraoka |

*Primary Examiner*—Teri Pham Luu

(57) ABSTRACT

An inflatable seat cushion having separate compartment that can either exchange air between them or not acording to adjustments made by the user. The seat can also be folded into a small package when not in use.

2 Claims, 2 Drawing Sheets

INFLATABLE SEAT CUSHION

This application claims priority based on provisional application 60/360,666 filed Mar. 4, 2002.

BACKGROUND OF THE INVENTION

1. Field of the Invention

The invention relates generally to seating cushions and more particularly to seat cushions that are inflatable.

2. Background of the Invention

Inflatable seat cushions have been developped primarily for people attending sporting events or any other activities requiring sitting over prolonged periods of time and where the only available seating is on a hard or otherwise uncomfortable surface. Besides inflatable cushions, cushions made of soft synthetic composites are also popular. The advantage, of course, of inflatable devices is that they can be made easily transportable once deflated and folded, as demonstrated by U.S. Pat. No. 4,708,393 by Fallis, U.S. Pat. No. 4,945,589 by Carey and U.S. Pat. No. 5,120,111 by Cook who describe inflatable seat cushions that can be folded into a coat pocket or combined into a carrying bag. The other patents of the prior art are more specialized like U.S. Pat. No. 3,296,635 by O'hanlan conceived for airplane pilots, U.S. Pat. No. 5,333,336 by Langsam discloses a booster seat for children. U.S. Pat. No. 4,781,413 by Shumack discloses a somewhat elaborate stadium seat partially inflatable to select the comfort level. U.S. Pat. No. 5,548,948 by Smith and U.S. Pat. No. 5,033,133 by Nissen are other examples of simple inflatable cushions. However, none of the prior art shows the same features as the inflatable cushion of this application.

SUMMARY OF THE INVENTION

It is an object of this invention to provide for a simple to use inflatable cushion offering a simple way of controlling firmness without having to add or remove air.

The present invention discloses an inflatable cushion that features a unique air flow system which controls the flow of air between two separate compartments. In one mode, the air is allowed to circulate from the left side of the cushion towards the right side and vice versa, as the user's weight shifts from one side to the other or, in the alternate mode, the air is locked inside each of the two compartments which provides for a firmer cushion.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

FIG. 1*a* is a top view, partially see through of the inflatable seat cushion.

FIG. 1*b* is a top view showing the hooks and pile.

FIG. 2*a* is a top view with the neck partially closed and showing one hook and one pile.

FIG. 2*b* is a top view showing the opening between the two air compartments.

DETAILED DESCRIPTION OF THE PREFERRED EMBODIMENT

Figure 1:
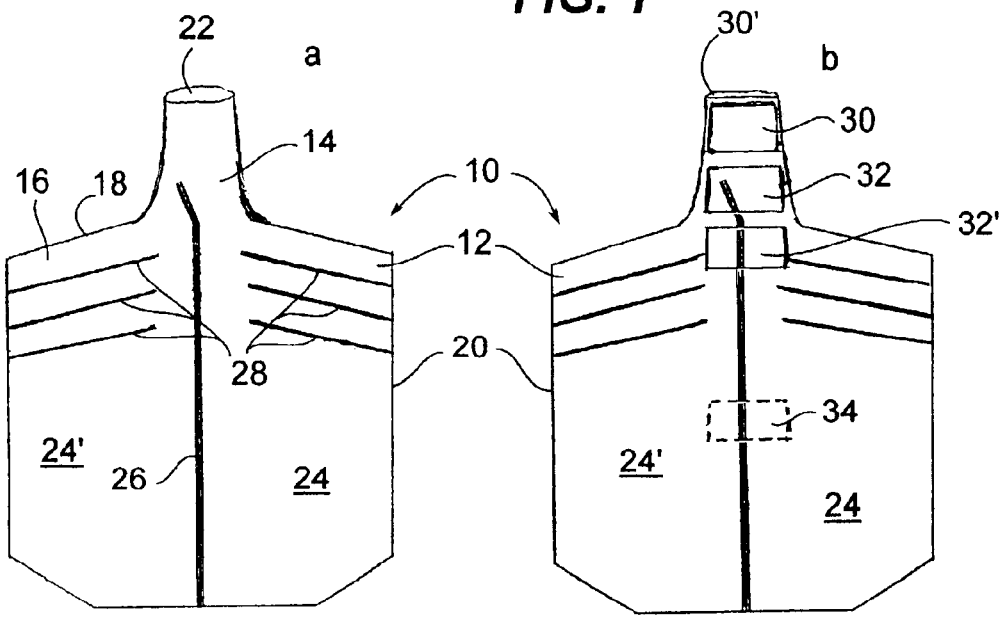
Figure 2:
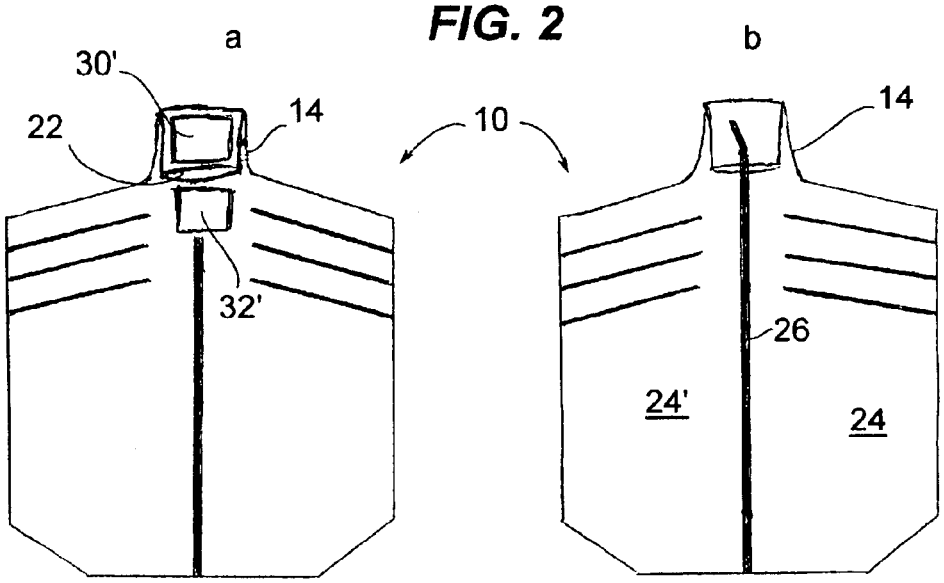
Figure 3:
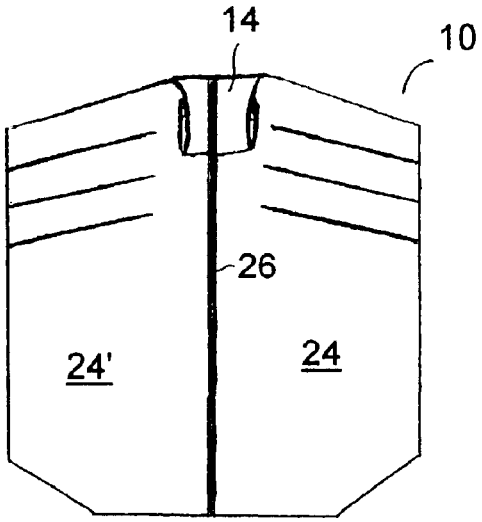
FIG. 3 is a top view showing the neck fully folded and air locked in each compartment.

FIGS. 1, 2, 3 An inflatable seat cushion (10) is comprised of a body (12), a neck (14) extending therefrom and both are comprised of a first face (16) and a second face (18) opposite the first face (16). The two faces (16, 18) of the body (12) and the neck (14) are joined together at the perimeter (20) except at a neck opening (22) situated at the tip of the neck (14), thus turning the body (12) into a hollow expandable containment. The neck opening (22) allows passage of air used for inflating the two adjoining compartments (24 and 24'), each being separated by a partition (26). A series of two pairs of ribs (28) creates sub partitions in each of the compartments (24 and 24'). The purpose of these ribs (28) is to limit vertical expansion of the compartments (24, 24'). Indeed, the ribs (28) keep the inflatable cushion (10) thinner towards the front, where the thighs of a user are, and the rest of the infaltable cushion (10) is kept thicker since this is where most of the body weight will be applied.

A first pile patch (30) situated on the top of the neck (14) on the first face (16) with a similar pile patch (30') situated on the second face of the neck (14). A first and a second hook patch (32, 32') situated along the neck (14) below the first pile patch (30) and one midway hook patch (34) situated midway on the body (12) and on the second face (18).

To use the inflatable seat cushion (10), pressure is induced into the body (12) from the neck opening (22). Generally, air is blown by the user (36) but any other type of gas, liquid or even gel, as used in some bicycle seats, could actually be employed to provide inflation.

Once enough pressure has been induced, the first pile patch (30) is folded so that it mates with the first hook patch (32). At this point pressure is contained inside both compartments (24, 24') and air, or anything else that has been introduced inside the compartments (24, 24') can circulate freely between each compartment because the partitionn (26) doesn't go all the way to the end of the neck (14), this shifting between compartments (24, 24') allows the inflatable seat cushion (10) to better take body shifts. Optionally the neck (14) can be further folded so that the similar pile patch (30') mates with the second hook patch (32'), this way, the compartments (24, 24') are separated and no pressure can shift betwen them, this gives the inflatable seat cushion (10) a more stable rigid feel. After use, pressure is taken out of the body by unfolding the neck and the inflatable seat cushion (10) can be folded width wise then lengthwise so that the midway hook patch (34) mates with the first pile patch (30).

Figure 4:
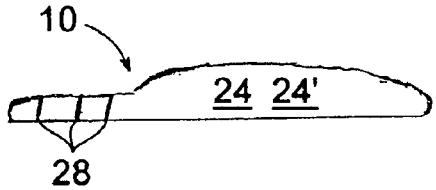
FIG. 4 is a side view of the inflated cushion.

FIG. 4 shows a side elevation to give a better view of the ribs (28) as they keep the inflatable seat cushion (10) thinner towards the front where the thighs of a user (36) are.

Figure 5:
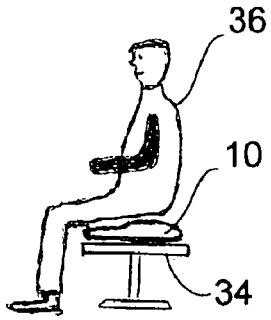
FIG. 5 is a side view of the cushion in use.

FIG. 5 Shows a side view of the inflatable seat cushion (10) with a user (36) on a bench (34).

Figure 6:
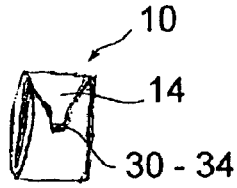
FIG. 6 is a front view of the cushion in storage mode.

FIG. 6 is a front view of the inflatable seat cushion (10) in storage mode with the neck (14) so that it acts as a closing flap, as the first pile patch (30) mates with the midway hook patch (34).

What is claimed is:

1. An inflatable seat cushion comprising:

a body, a neck extending therefrom and both of the said body and said neck are comprised of a first face and a second face opposite the first said face;

the two faces of the body and neck being joined together at the perimeter except at a neck opening situated at the tip of the neck, thus creating a hollow expandable containment;

the neck having the neck opening at its tip to allow passage of air;

the body further comprised of two adjoining compartments separated by a partition; ribs creating sub partitions in each of the said compartments to limit vertical expansion of the said compartments;

a first pile patch situated on the top of the neck on the first face with a similar pile patch situated on the second face of the said neck;

a first and a second hook patch situated along the neck below the first pile patch; one midway hook patch situated midway on the body and on the second face.

2. An inflatable seat cushion having the following method of use:

pressure is induced into the body from the opened tip of the neck;

the first pile patch is folded so that it mates with the first hook patch;

optionally the neck can be further folded so that the similar pile patch mates with a second hook patch;

pressure is taken out of said body by unfolding said neck;

said inflatable seat cushion is folded width wise then lengthwise so that a midway hook patch mates with said first pile patch.

* * * * *